US006087935A

United States Patent [19]

Berner et al.

[11] Patent Number: 6,087,935

[45] Date of Patent: Jul. 11, 2000

[54] SMOKE-SCREEN FOR OBSCURING PREMISES

[75] Inventors: Joachim Berner, Holzgerlingen; Ulrich Frick, Stuttgart, both of Germany

[73] Assignee: Innovative Pyrotechnik GmbH, Boblingen, Germany

[21] Appl. No.: 09/068,771

[22] PCT Filed: Nov. 6, 1996

[86] PCT No.: PCT/DE96/02114

§ 371 Date: Oct. 5, 1998

§ 102(e) Date: Oct. 5, 1998

[87] PCT Pub. No.: WO97/18373

PCT Pub. Date: May 22, 1997

[30] Foreign Application Priority Data

Nov. 17, 1995 [DE] Germany ..... 195 42 950
Jan. 9, 1996 [DE] Germany ..... 295 20 736 U

[51] Int. Cl.[7] ..... G08B 19/00

[52] U.S. Cl. ..... 340/541; 340/529; 340/522; 424/40; 424/42; 102/334

[58] Field of Search ..... 340/522, 529, 340/571, 568.7, 541; 102/209, 334, 329, 370; 219/272, 273, 275; 392/396, 397, 136; 424/40, 42

[56] References Cited

U.S. PATENT DOCUMENTS 3,891,826 6/1975 Seuthe ..... 219/273
3,911,823 10/1975 Murray et al. ..... 102/86.5
4,547,656 10/1985 Swiatosz et al. ..... 219/300
4,859,454 8/1989 Barruet et al. ..... 424/40
5,410,295 4/1995 Lint ..... 340/568.7
5,647,054 7/1997 Jones ..... 392/397

FOREIGN PATENT DOCUMENTS 85400495 3/1985 European Pat. Off. .
0726550A1 1/1996 European Pat. Off. .
4328697 A1 8/1993 Germany .
2270396 3/1994 United Kingdom .

*Primary Examiner*—Daniel J. Wu
*Assistant Examiner*—Van T. Trieu
*Attorney, Agent, or Firm*—Blank Rome Comisky & McCauley, LLP

[57] ABSTRACT

A smoke screen device for rooms includes a container to hold a smoke fluid that produces smoke when vaporized, a heating device for heating and vaporizing the smoke fluid, and an opening in the container that allows the smoke to be given off into the open. The heating device is a pyrotechnic heating cartridge having a heating agent, a pyrotechnic detonating agent, and a casing that encloses the heating agent and detonating agent. Heat produced during combustion of the heating agent is given off onto the smoke fluid through a wall of the casing. A pressure cartridge including a compression agent and a pyrotechnic detonating device is provided in the container to support propulsion of the smoke produced. The pyrotechnic detonating device may be electrically ignitable via an electrical cable coupled to an energy supply and sensory mechanism which themselves are connected to an alarm, so that when tripped, the alarm causes the detonating device to be ignited. The pyrotechnic compression agent and the heating agent may be contained in a common casing.

9 Claims, 3 Drawing Sheets

SMOKE-SCREEN FOR OBSCURING PREMISES

BACKGROUND OF THE INVENTION

The invention concerns a smoke screen device for rooms and is to be used, in particular, to blind burglars in closed rooms and make them panic so they are stopped from stealing objects. Such devices can be set off by a traditional alarm or another suitable means. When setting off the device other alarm systems, of course, can also be set in operation so the owner or, if applicable, the police can take further defensive measures against the burglar(s).

Such a device is known from German document No. DE-A1-43 28 697. This system has a distributor that distributes blinding smoke like an explosive. As a basis for the production of the smoke, known components as are sometimes used in smoke grenades can be used. It is, of course, assumed that these substances are not toxic so an endangerment to health can be ruled out.

With respect to compact smoke screen devices for rooms it is also known to provide a smoke screen in a room by holding a mixture of water and glycol in a container that is heated by strong heating pipes to several hundred degrees Celsius within seconds. This procedure produces thick clouds of smoke so a burglar completely loses his orientation in a room within a very short time. For this device, however, one needs a considerable power supply; is this naturally poses the risk that the smoke screen will not occur if the power fails.

The invention is based on the technical problem of creating a simply constructed device that is essentially independent of the power supply and that can be set off, for example, by simply connecting it to an existing alarm system.

OBJECTS AND SUMMARY OF THE INVENTION

This problem is solved according to the invention by the provision of a smoke screen device for rooms, in which the device includes a container to hold a smoke fluid that produces smoke when vaporized, with a heating device for heating and vaporizing the smoke fluid, and with an opening in the container that allows the smoke to be given off into the open, wherein the heating device is a pyrotechnic heating cartridge with a heating agent, a pyrotechnic detonating agent, and a casing that encloses the heating agent and detonating agent, and the heat produced during combustion of the heating agent is given off through the wall of the casing onto the smoke fluid.

The basic idea of the invention is the construction of the active parts of the device, which are essential for creating the smoke screen, as pyrotechnic agents that can be activated independent of a power supply. Only a small primer capsule must be activated, for whose maintenance a small battery or the connection to a sensory mechanism of an alarm device is sufficient.

With a suitable form of a heating cartridge, the pressure that occurs when the mixture is heated and vaporized to produce the smoke can be sufficient to exude smoke from the container via an opening with a valve. It is nonetheless advantageous to place another pyrotechnic compression agent in the container, which is ignited either synchronously when the heating agent is ignited or later and which develops the respective propellant gases during combustion. These propellant gases stream in through a connection in the container and produce pressure there that is sufficient to cause the smoke to stream forth. The compression agent can be put in the same casing as the heating agent or it can be integrated into it. This compression agent is also, preferably, a pyrotechnic agent.

BRIEF DESCRIPTION OF THE DRAWINGS

Further forms of the invention follow from the subclaims. The invention is illustrated in greater detail in the working examples with the use of drawings. The following figures are represented.

DESCRIPTION OF THE PREFERRED EMBODIMENT

Figure 1:
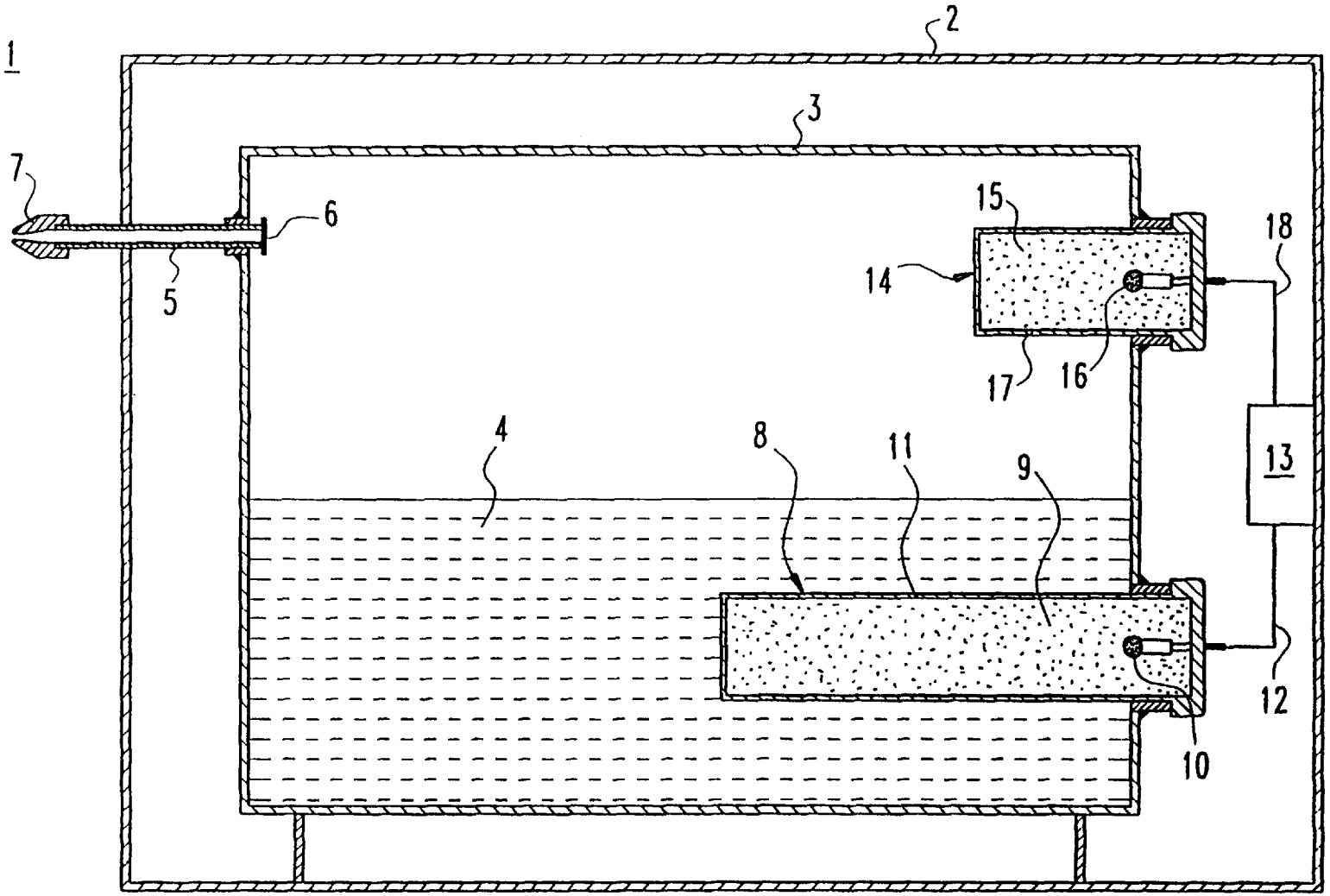
FIG. 1 shows a longitudinal cut through a device for providing a smoke screen in rooms according to the invention.

In accordance with FIG. 1, a smoke screen device 1 for rooms has an outer casing 2, in which a container 3 is stored for holding a smoke fluid 4. This smoke fluid 4 is, for example, a mixture of water and glycol that fills the container about half-way in this case. In the fluid-free space a conduit 5 leads from the container, which is closed by a bursting disk 6. This conduit also penetrates the casing 2 and empties into a nozzle 7 outside the casing 2.

At the side of the container 3 a pyrotechnic heating cartridge 8, which has a heating agent 9 and a pyrotechnic primer capsule 10, extends into the smoke fluid 4; the capsule 10 is contained in a solid, pressurized, gas-proof casing 11. The pyrotechnic primer capsule 10 can be ignited, for example, electrically through a cable 12, which leads from the primer capsule 10 to a sensory mechanism and power supply 13.

A pressure cartridge 14, which has a compression agent 15 and a pyrotechnic primer capsule 16 that is put in a container 17, extends into the fluid-free space of the container 3. The pyrotechnic primer capsule 16 can also be ignited electrically via a cable 18, which leads from the primer capsule to the sensory mechanism and energy supply 13.

The sensory mechanism and energy supply 13 receive an activation signal from, for example, an alarm system 19 when a break-in has been determined. The sensory mechanism and energy supply 13 can contain, for example, a small electric battery and a small logic device, which control the functioning of the apparatus. The operating method is as follows.

As soon as the sensory mechanism and energy supply 13 receive an activation signal from the alarm system, an electrical impulse is sent through the cable 12 to the pyrotechnic primer capsule 10 of the pyrotechnic heating cartridge 8. Through this the heating agent 9 is ignited and burns relatively quickly. The heat produced by the combustion is given off through the casing 11 onto the smoke fluid 4, which is warmed very quickly and vaporizes. As soon as the steam pressure inside the container is high enough, the bursting disk 6 is destroyed so the cloud of smoke can escape through the conduit 5 and nozzle 7 and quickly create a smoke screen in the room that is to be protected.

If the gas pressure produced by the vaporization of the smoke fluid inside the container is not sufficient to destroy the bursting disk 6 and propel the cloud of smoke out, the pyrotechnic primer capsule 16 of the compression agent 15 is ignited either at the same time as the pyrotechnic primer capsule 10 or with a delay—depending on the time period necessary for the vaporization of the smoke fluid 4. The outer wall of the pressure cartridge 14 is destroyed upon ignition so that during the combustion of the compression agent 15 free propellant gases are released into the container 3. The inner pressure rises in the container so the bursting disk 6 is destroyed and the vaporized smoke fluid is driven out.

Figure 2:
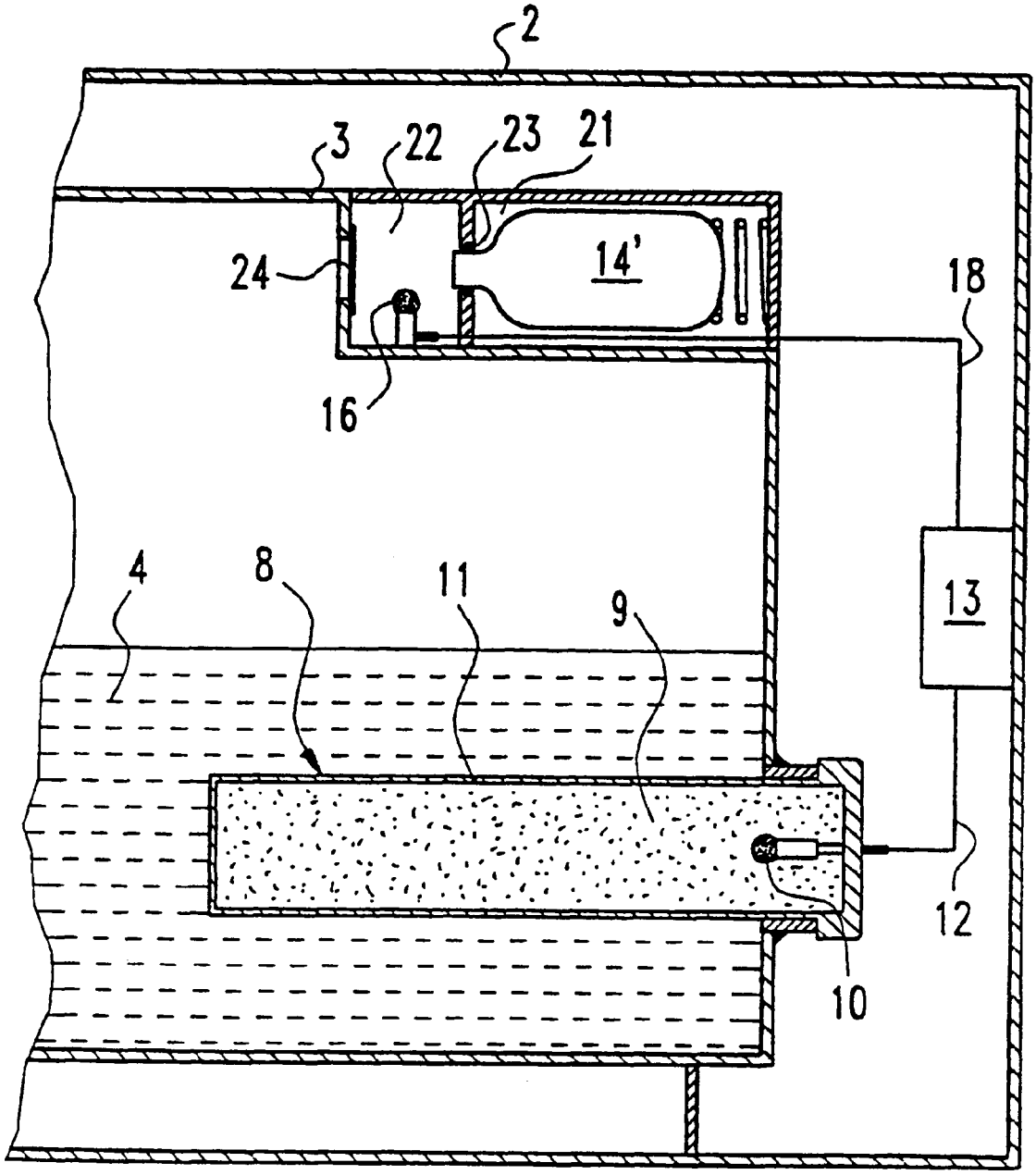
FIG. 2 is a partial longitudinal cut similar to FIG. 1 but showing an alternative embodiment.

An alternative embodiment to that of FIG. 1 is shown in FIG. 2. The difference is that instead of the pyrotechnic compression agent 15 of the embodiment of FIG. 1, a sealed $CO_2$ cartridge 14' is used in the embodiment of FIG. 2. Cartridge 14' is positioned in a compartment 21 with its orifice in a small ignition chamber 22. The compartment 21 and ignition chamber 22 are sealed gas-tight by an O-ring 23. As in the embodiment of FIG. 1, pyrotechnic primer capsule 16 is ignited electrically via cable 18 which leads to sensory mechanism and energy supply 13, but here the orifice of cartridge 14' is thereby opened which destroys bursting disc 24 that otherwise seals the outlet of ignition chamber 22 and allows the $CO_2$ gas to enter container 3 and onto smoke fluid 4.

Figure 3:
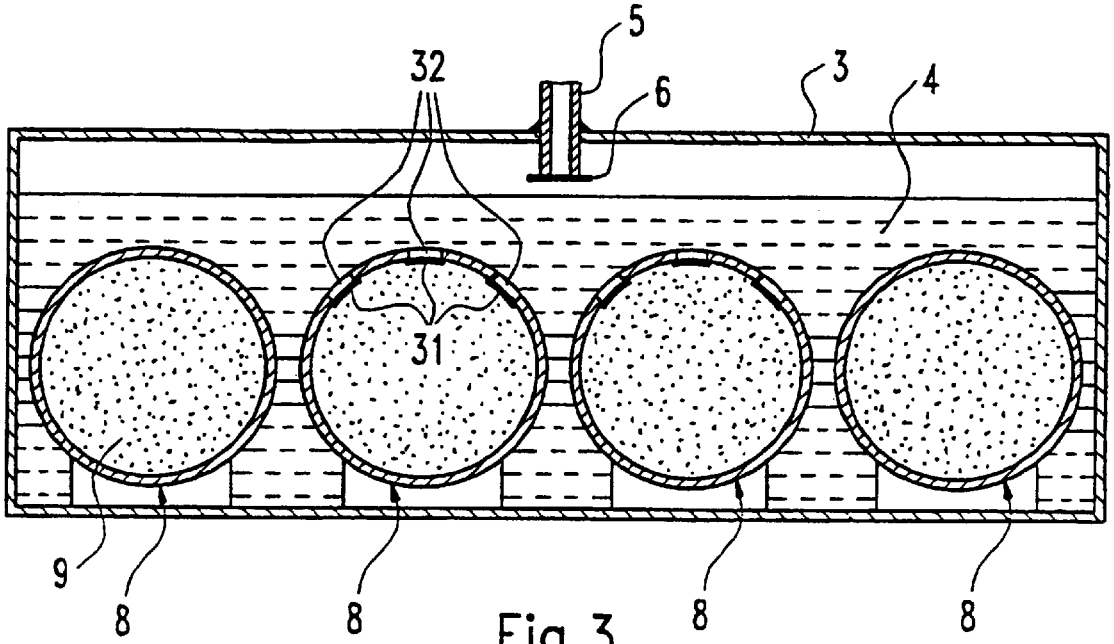
FIGS. 3 and 4 show a longitudinal and cross section through another working example of such a device.
Figure 4:
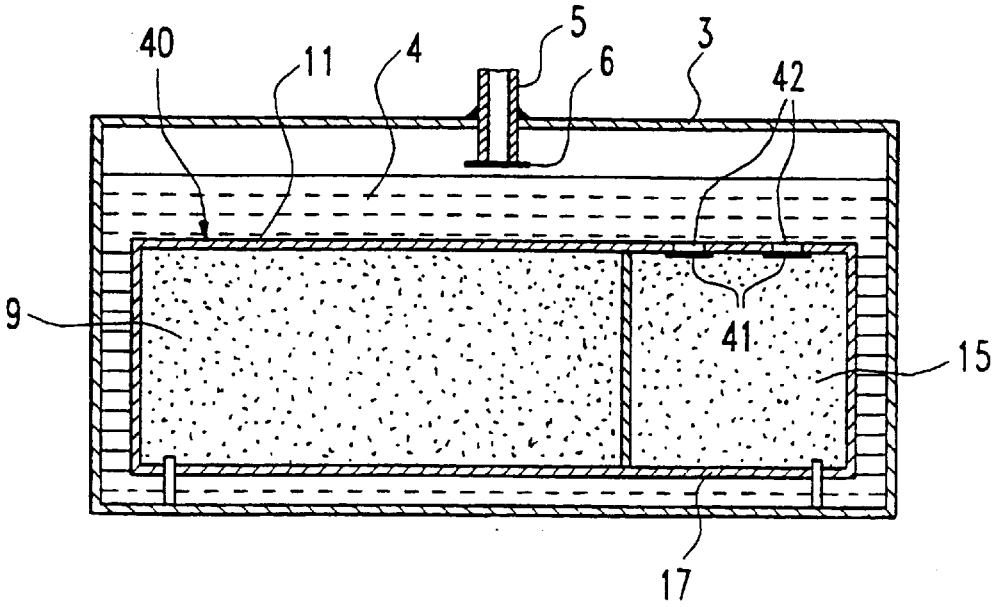

In FIGS. 3 and 4 only the inner container 3 of a variation of the working example of a smoke screen device for rooms is represented. A smoke fluid 4 is poured into the container 3; in addition, several pyrotechnic heating cartridges 8 are present—in this case four cartridges. One of these cartridges can nonetheless be a pressure cartridge. Similarly, it is possible for the individual heating cartridges to have both a pyrotechnic heating agent 9 and a compression agent 15, as is shown diagrammatically in FIG. 4. The heating cartridge 9 here is again enclosed by a casing 11 so that during the combustion of the heating agent no gas can escape. Preferably, in this working example the two agents are ignited one after the other, whereby the heating agent 15 is only ignited when the smoke fluid 4 exists as a vapor. As soon as the inner pressure in the container is high enough, the bursting disk 6 at the end of the conduit is destroyed so the clouds of smoke are pushed out of the container.

In the embodiment according to FIG. 4 the pyrotechnical pressure charge 15 and the pyrotechnical heating charge 9 are contained in a common housing 40. The casing 11 of the heating charge may be gastight as in the other embodiments. The outlets 42 in the casing 17 of the pressure charge may be closed by bursting foils 41. The housing 40 is arranged within a container 3 filled with a smoke generating fluid and is provided with an outlet 5 covered by a bursting disk 6.

The advantages of the devices described compared to the traditional methods are, among other things, their very quick ability to function after being set off, as a result of which clouds of smoke can be released in a time period of 3 to 20 seconds depending on the design. No pyrotechnic gases or smoke are emitted because in this device normal smoke fluid like that used in electrical smoke machines is used. The device is inexpensive to produce because its construction is very simple compared to other electrical devices used, for instance, at theater performances. A further advantage is that its function cannot be stopped after the device has been activated—i.e., a self-sufficient operating mechanism exists. The device can easily be connected to any alarm system. Servicing is also easy, for no expendable parts have been built in. Reliable operation is guaranteed by an uncomplicated technique. The device can be used under extreme conditions, e.g., in extremely dirty rooms, and is not sensitive to hot or cold.

What is claimed is:

1. A smoke screen device for rooms comprising a container to hold a smoke fluid which produces smoke when vaporized, a heating device for heating and vaporizing the smoke fluid, and an opening in the container that allows the smoke to be given off into the open, characterized in that the heating device is a pyrotechnic heating cartridge having a heating agent, a pyrotechnic detonating agent and a casing that encloses the heating agent and detonating agent, wherein heat produced during combustion of the heating agent is given off onto the smoke fluid through a wall of the casing, a pressure cartridge being provided in the container to support propulsion of the smoke produced, said pressure cartridge comprising a pyrotechnic compression agent and a pyrotechnic detonating device.

2. The smoke screen device according to claim 1 wherein the casing of the pyrotechnic heating cartridge is pressurized and gas-proof.

3. The smoke screen device according to claim 1 wherein the pyrotechnic heating cartridge is dipped into the smoke fluid.

4. The smoke screen device according to claim 1 wherein the detonating agent for the pyrotechnic heating agent is a pyrotechnic primer capsule.

5. The smoke screen device according to claim 4 wherein the pyrotechnic primer capsule is electrically ignitable.

6. The smoke screen device according to claim 1 wherein said pyrotechnic detonating device is electrically ignitable.

7. The smoke screen device according to claim 1 including a sensory mechanism and energy supply for igniting the pyrotechnic agents.

8. The smoke screen device according to claim 7 wherein said sensory mechanism and energy supply are connected to an alarm system.

9. The smoke screen device according to 1 wherein said pyrotechnic compression agent and said heating agent are contained in a common casing.

* * * * *